US011319970B2

(12) United States Patent
Masuo

(10) Patent No.: US 11,319,970 B2
(45) Date of Patent: May 3, 2022

(54) AXIAL FLOW FAN DEVICE

(71) Applicant: MINEBEA MITSUMI Inc., Nagano (JP)

(72) Inventor: Satoshi Masuo, Miyota-machi (JP)

(73) Assignee: MINEBEA MITSUMI Inc., Nagano (JP)

( * ) Notice: Subject to any disclaimer, the term of this patent is extended or adjusted under 35 U.S.C. 154(b) by 95 days.

(21) Appl. No.: 16/881,371

(22) Filed: May 22, 2020

(65) Prior Publication Data

US 2020/0378401 A1 Dec. 3, 2020

(30) Foreign Application Priority Data

May 31, 2019 (JP) ..... JP2019-103292

(51) Int. Cl.
*F04D 29/40* (2006.01)
*F04D 25/16* (2006.01)
*F04D 19/00* (2006.01)

(52) U.S. Cl.
CPC ..... *F04D 29/403* (2013.01); *F04D 19/002* (2013.01); *F04D 25/166* (2013.01); *F05B 2230/60* (2013.01)

(58) Field of Classification Search
CPC .... F04D 29/403; F04D 19/002; F04D 25/166; F04D 19/007; F04D 19/024; F04D 29/522; F04D 29/646; F04D 25/08; F04D 29/545; F05B 2230/60; F05D 2260/36
See application file for complete search history.

(56) References Cited

U.S. PATENT DOCUMENTS 7,445,423 B2 * 11/2008 Ishihara ..... F04D 19/007 415/193
7,654,792 B2 2/2010 Kikuichi et al.
8,133,006 B2 * 3/2012 Yoshida ..... F04D 25/0613 415/68
8,322,998 B2 * 12/2012 Hanaoka ..... F04D 19/007 417/244
8,475,126 B2 7/2013 Yoshida et al.
8,932,014 B2 1/2015 Zhao et al.
9,022,724 B2 * 5/2015 Liu ..... F04D 19/007 415/68
9,551,346 B2 * 1/2017 Kitamura ..... F04D 29/384
9,739,291 B2 * 8/2017 Masuo ..... F04D 29/668
(Continued)

FOREIGN PATENT DOCUMENTS

JP 2004-278371 A 10/2004

*Primary Examiner* — Aaron R Eastman
(74) *Attorney, Agent, or Firm* — Pearne & Gordon LLP

(57) ABSTRACT

An axial flow fan device 1 includes a first axial flow fan 10 and a second axial flow fan 20. The first axial flow fan 10 of a first casing 14 includes first engagement portions 152. Two sets of first engagement portions 152 are provided at positions which protrude outward in the direction of the axis x from a first base portion 16, and which are symmetrical with respect to the axis x, each first engagement portion 152 having a stepped portion in the radial direction. The second axial flow fan 20 of a second casing 24 includes second engagement portions 252. Two sets of second engagement portions 252 are provided on a second peripheral wall 241 at positions which are symmetrical with respect to the axis x, each second engagement portion 252 having a stepped portion in the radial direction.

4 Claims, 11 Drawing Sheets

(56) References Cited

U.S. PATENT DOCUMENTS

| | | | | |
|---|---|---|---|---|
| 10,837,448 | B2 * | 11/2020 | Kato | H02K 7/14 |
| 2005/0106026 | A1 * | 5/2005 | Oosawa | F04D 29/646 416/198 R |
| 2016/0298653 | A1 * | 10/2016 | Masuo | G06F 1/183 |

* cited by examiner

AXIAL FLOW FAN DEVICE

CROSS REFERENCE TO RELATED APPLICATIONS

This application claims the benefit of Japanese Patent Application No. 2019-2019-103292, filed May 31, 2019, which is hereby incorporated by reference in its entirety.

BACKGROUND

Technical Field

The present disclosure relates to an axial flow fan device.

Background

In general, electronic equipment, such as a computer or a server, includes a fan device to cool electronic components in a housing. As such a fan device, for example, the following counter-rotating axial flow blower is known (see Japanese Patent Laid-Open No. 2004-278371 (Patent Document 1)). The counter-rotating axial flow blower includes two axial flow fans, each of which uses a motor as a drive source, and the two axial flow fans are disposed such that the rotational direction of one axial flow fan and the rotational direction of another axial flow fan are opposite to each other in the direction of an axis.

The counter-rotating axial flow blower disclosed in Patent Document 1 is configured such that, to use a plurality of fans in a coupled state in the direction of the axis, four fitting grooves are formed on a first casing of a first axial flow fan (single axial flow blower), and four hooks are formed on a second casing of a second axial flow fan (single axial flow blower). In this counter-rotating axial flow blower, when the first casing and the second casing are rotated relative to each other in a state where the four hooks are respectively inserted into the four fitting grooves, the hooks are respectively engaged with the fitting grooves, thus preventing removal of the hooks in the direction of the axis.

SUMMARY

In the axial flow fan device including engagement portions, by which the casings of the plurality of axial flow fans are engaged, such as the counter-rotating axial flow blower disclosed in Patent Document 1, there is a demand that the plurality of casings are firmly coupled with each other during use and, at the same time, the plurality of casings are easily detachable for performing a disassembly operation or the like.

However, in a conventional fan device including the engagement portions by which the casings of the plurality of axial flow fans are engaged, it is difficult to achieve both firm coupling of the plurality of casings and easy detachment of the casings for performing a disassembly operation or the like. Further, in the above-mentioned counter-rotating axial flow blower, there may be a case where, in coupling two casings by rotating, a force is concentrated on one of the four hooks due to eccentricity of torque generated in the two casings so that the hook is broken. As described above, in the conventional fan device including the engagement portions by which the casings of the plurality of axial flow fans are engaged, there is a demand that the engagement portions are easily detachable, and breakage of the engagement portion can be suppressed to increase the utility of the engagement portions.

The present disclosure is related to providing an axial flow fan device which can increase the utility of the engagement portions by which the casings of the plurality of axial flow fans are engaged.

In accordance with one aspect of the present disclosure, there is provided an axial flow fan device including: a first axial flow fan; and a second axial flow fan, the first axial flow fan and the second axial flow fan being coupled with each other in a direction of an axis, wherein the first axial flow fan includes a first impeller and a first casing, the first impeller including a plurality of blades, the first casing accommodating a first motor which rotates a center shaft of the first impeller, the first casing includes a first peripheral wall formed to surround an outer periphery of the first impeller, a first base portion provided on a bottom surface of the first peripheral wall to support the first motor, and first engagement portions each having a stepped portion in a radial direction, two sets of the first engagement portions being provided at positions which protrude outward in the direction of the axis from the first base portion, and which are symmetrical with respect to the axis, the second axial flow fan includes a second impeller and a second casing, the second impeller including a plurality of blades, the second casing accommodating a second motor which rotates a center shaft of the second impeller, and the second casing includes a second peripheral wall surrounding an outer periphery of the second impeller, at least a portion of an outer peripheral surface of the second peripheral wall being formed into an arc shape about the axis, a second base portion provided on a bottom surface of the second peripheral wall to support the second motor, and second engagement portions each having a stepped portion in the radial direction, two sets of the second engagement portions being provided on the second peripheral wall at positions which are symmetrical with respect to the axis.

In the axial flow fan device according to one aspect, the second engagement portions are provided on the second peripheral wall at positions which correspond to the first engagement portions in a circumferential direction, and with rotation of the first casing and the second casing in the circumferential direction with an end surface of the first casing and an end surface of the second casing contacting each other, the first engagement portions get over the second engagement portions, thus being engaged with the second engagement portions so that positions of the first engagement portions and positions of the second engagement portions in the circumferential direction are fixed.

In the axial flow fan device according to one aspect, the first casing includes a first engagement flange portion provided to protrude outward in the direction of the axis from a front surface of the first base portion, an inner peripheral surface of the first engagement flange portion being formed into an arc shape about the axis along the second peripheral wall, and the first engagement portion is provided on the first engagement flange portion.

In the axial flow fan device according to one aspect, the first engagement flange portion has a through hole which penetrates in the direction of the axis.

In the axial flow fan device according to one aspect, the second casing includes a second engagement flange portion provided to protrude outward in the direction of the axis from a front surface of the second base portion.

In the axial flow fan device according to one aspect, the second engagement flange portion contacts the first engagement flange portion in a state where the first engagement portions and the second engagement portions are engaged with each other.

In the axial flow fan device according to one aspect, the second engagement flange portion includes a joint portion and a protruding portion, the joint portion having a surface formed to extend in the radial direction, and joined with the first engagement flange portion, the protruding portion being formed to extend in a direction opposite to a rotational direction from an end portion of the joint portion on an outer side in the direction of the axis.

In the axial flow fan device according to one aspect, the first engagement portion protrudes inward in the radial direction, and the second engagement portion protrudes outward in the radial direction.

In the axial flow fan device according to one aspect, the first base portion includes a plurality of fixed blades, and the second base portion includes a plurality of fixed blades, and positions of the plurality of fixed blades of the first base portion and positions of the plurality of fixed blades of the second base portion correspond to each other in the circumferential direction in a state where the first engagement portions and the second engagement portions are engaged with each other.

According to the axial flow fan device according to the present disclosure, it is possible to increase the utility of the engagement portions by which the casings of the plurality of axial flow fans are engaged.

DETAILED DESCRIPTION

Hereinafter, an axial flow fan device 1 according to an embodiment of the present disclosure will be described with reference to accompanying drawings.

Figure 1:
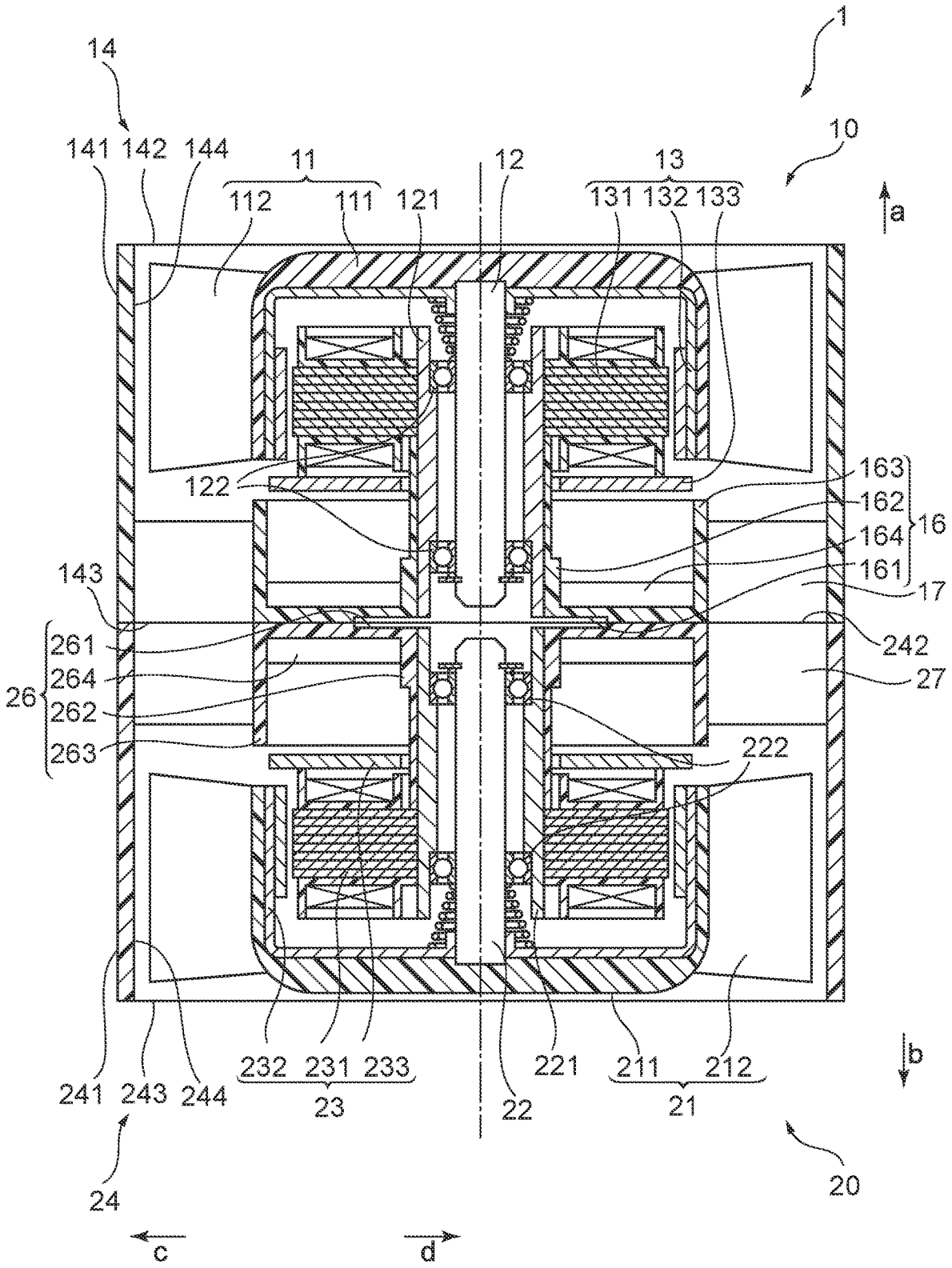
FIG. 1 is a cross-sectional view schematically showing a configuration of an axial flow fan device according to an embodiment of the present disclosure.

FIG. 1 is a cross-sectional view schematically showing the configuration of the axial flow fan device 1 according to the embodiment of the present disclosure.

In the description made hereinafter, for the sake of convenience, a direction indicated by an arrow "a" in the direction of an axis x is taken as an upper side "a", and a direction indicated by an arrow "b" is taken as a lower side "b". Further, in a radial direction perpendicular to the axis x, a direction away from the axis x (a direction indicated by an arrow "c" in FIG. 1) is taken as an outer peripheral side "c", and a direction toward the axis x (a direction indicated by an arrow "d" in FIG. 1) is taken as an inner peripheral side "d". In the description made hereinafter, a direction drawing a circle about the axis x is taken as a circumferential direction. In the description made hereinafter, for the sake of convenience, a side shown in FIG. 1 is assumed as the side surface of the axial flow fan device 1. Further, in the description made hereinafter, for the sake of convenience, the side of the axial flow fan device 1 when the axial flow fan device 1 is viewed from the upper side "a" toward the lower side "b" is assumed as a front surface, and a side of the axial flow fan device 1 when the axial flow fan device 1 is viewed from the lower side "b" toward the upper side "a" is assumed as a bottom surface.

As shown in FIG. 1, in the axial flow fan device 1 according to the present embodiment, a first axial flow fan 10 and a second axial flow fan 20 are coupled with each other in the direction of the axis x. The first axial flow fan 10 includes a first impeller 11 and a first casing 14, the first impeller 11 including a plurality of blades 112, the first casing 14 accommodating a first motor 13 which rotates a shaft 12, acting as the center shaft of the first impeller 11. The first casing 14 includes a first peripheral wall 141, a first base portion 16, and first engagement portions 152. The first peripheral wall 141 is formed to surround the outer periphery of the first impeller 11. The first base portion 16 is provided on the bottom surface of the first peripheral wall 141 to support the first motor 13. Two sets of first engagement portions 152 are provided at positions which protrude outward in the direction of the axis x from the first base portion 16, and which are symmetrical with respect to the axis x, each first engagement portion 152 having a stepped portion in the radial direction. The second axial flow fan 20 includes a second impeller 21 and a second casing 24, the second impeller 21 including a plurality of blades 212, the second casing 24 accommodating a second motor 23 which rotates a shaft 22, acting as the center shaft of the second impeller 21. The second casing 24 includes a second peripheral wall 241, a second base portion 26, and second engagement portions 252. The second peripheral wall 241 surrounds the outer periphery of the second impeller 21, and at least a portion of the outer peripheral surface of the second peripheral wall 241 is formed into an arc shape about the axis x. The second base portion 26 is provided on the bottom surface of the second peripheral wall 241 to support the second motor 23. Two sets of second engagement portions 252 are provided on the second peripheral wall 241 at positions which are symmetrical with respect to the axis x, each second engagement portion 252 having a stepped portion in the radial direction. Hereinafter, the configuration and the manner of operation of the axial flow fan device 1 will be specifically described.

In the axial flow fan device 1, the first axial flow fan 10 and the second axial flow fan 20 are coupled with each other in the direction of the axis x, the first axial flow fan 10 being positioned on the intake side, which is the upper side "a" in FIG. 1, the second axial flow fan 20 being positioned on the discharge side, which is the lower side "b" in FIG. 1. The axial flow fan device 1 is a counter-rotating axial flow blower which includes a plurality of axial flow fans consisting of the first axial flow fan 10 and the second axial flow fan 20, and where the rotational direction of the first axial flow fan 10 and the rotational direction of the second axial flow fan 20 are opposite to each other. In the axial flow fan device 1, the first axial flow fan 10 and the second axial flow fan 20 are coupled with each other such that the first base portion 16 of the first axial flow fan 10 and the second base portion 26 of the second axial flow fan 20 are disposed back to back.

[Schematic Configuration of First Axial Flow Fan]

Next, the configuration of the first axial flow fan 10 of the axial flow fan device 1 will be described.

As shown in FIG. 1, the first axial flow fan 10 includes the first impeller 11, the first motor 13, the first casing 14, first engagement flange portions 15, the first base portion 16, and first fixed blades 17.

The first impeller 11 is disposed in the first casing 14 about the axis x. The first impeller 11 includes a cup-shaped hub 111, and a plurality of (five, for example) blades 112, the hub 111 being open toward the lower side "b", the plurality of blades 112 being arranged equidistantly in the circumferential direction to extend from the outer peripheral surface of the hub 111. The first impeller 11 is formed such that the hub 111 and the blades 112 are integrally molded out of a resin.

The first motor 13 is formed of an outer rotor three-phase brushless motor, for example. The first motor 13 includes the shaft 12, a bearing holder 121, bearings 122, a stator core 131, and a rotor 132. A rotor magnet is attached to the inner peripheral surface of the rotor 132, and the rotor 132 is coupled to one end side of the shaft 12.

The shaft 12 is rotatably supported by the pair of bearings 122 mounted on the bearing holder 121.

The bearing holder 121 is mounted on a boss portion 162 of the first base portion 16. The bearing holder 121 is a cylindrical member made of metal (brass, for example), and has a space at an inner peripheral portion of the bearing holder 121. The bearing holder 121 is mounted on the first base portion 16, made of a resin, by a proper method, such as insertion molding. In the space at the inner peripheral portion of the bearing holder 121, the pair of bearings 122 which rotatably supports the shaft 12 of the first motor 13 is mounted.

The stator core 131 is mounted on the outer periphery of the bearing holder 121. A circuit board 133 having a donut shape, for example, is attached to the portion of the stator core 131 on the lower side "b". The hub 111 of the first impeller 11 is mounted on the outer peripheral surface of the rotor 132. In the first motor 13, the first impeller 11 also rotates with the rotation of the rotor 132.

[Configuration of First Casing]

Next, the configuration of the first casing 14 of the first axial flow fan 10 will be described.

Figure 2:
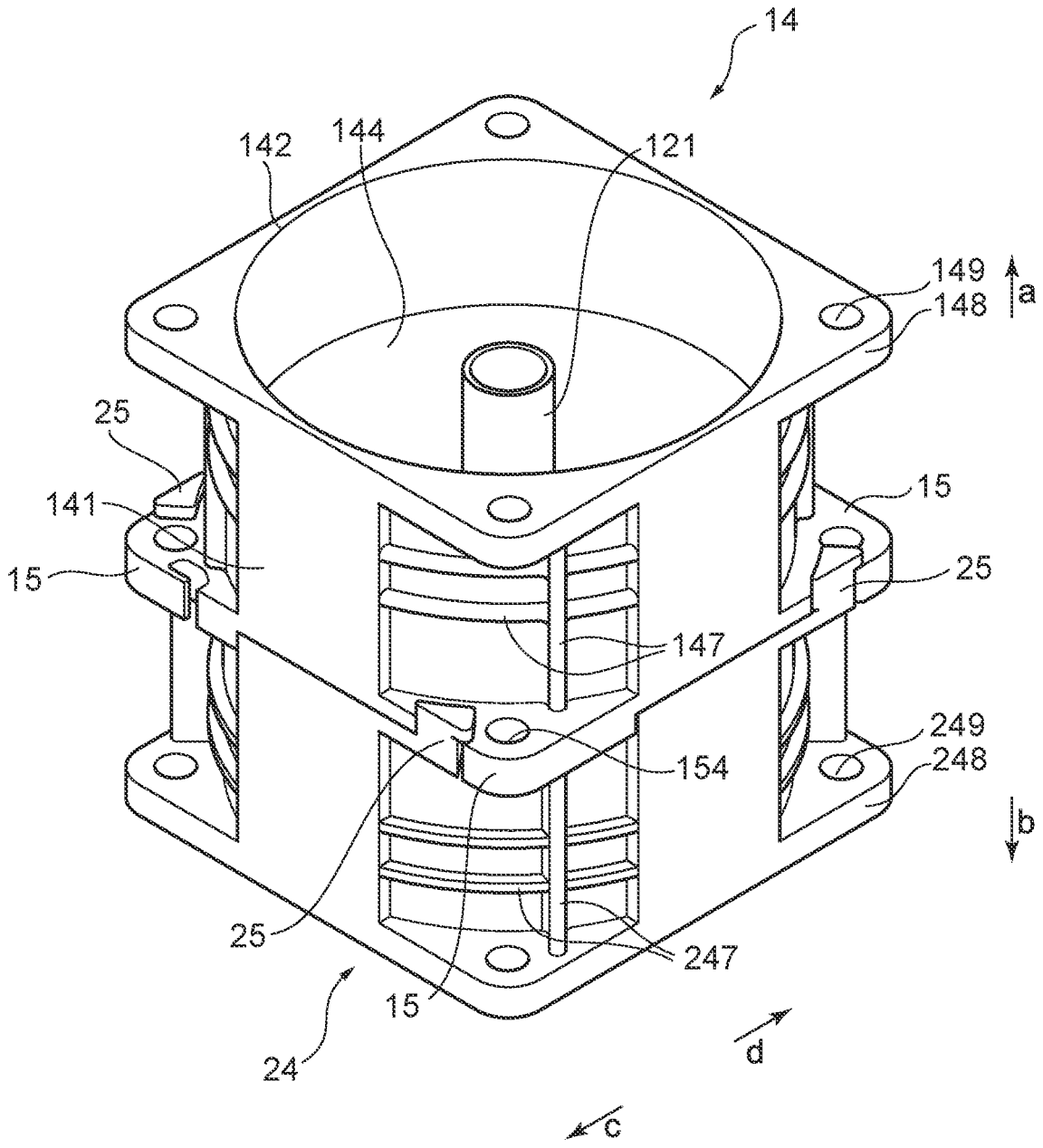
FIG. 2 is a perspective view schematically showing the configuration of a first casing and a second casing of the axial flow fan device shown in FIG. 1, and is also a perspective view showing a state of the first casing and the second casing as viewed from a suction port side of the first casing.
Figure 3:
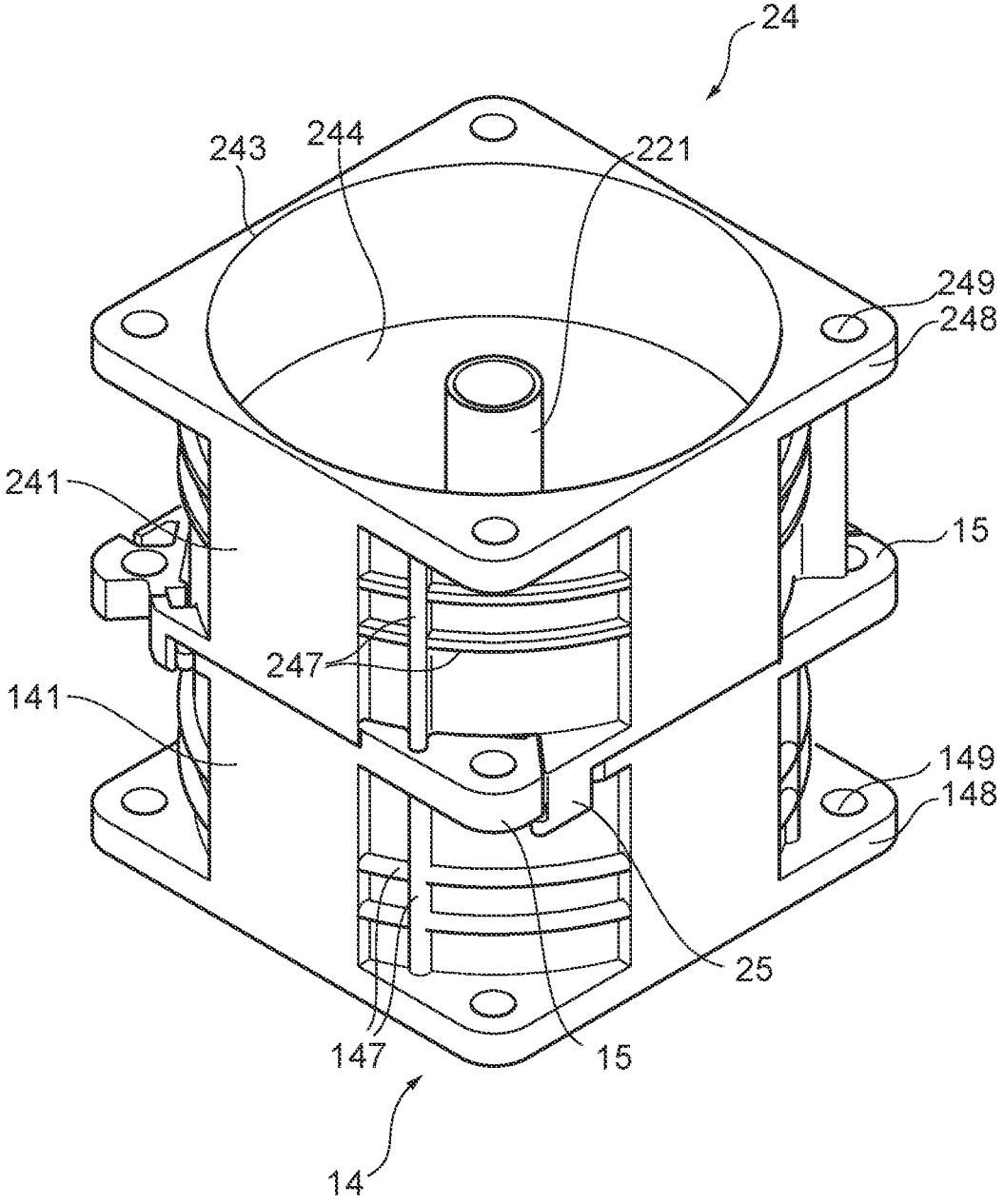
FIG. 3 is a perspective view schematically showing the configuration of the first casing and the second casing of the axial flow fan device shown in FIG. 1, and is also a perspective view showing a state of the first casing and the second casing as viewed from a discharge port side of the second casing.
Figure 4:
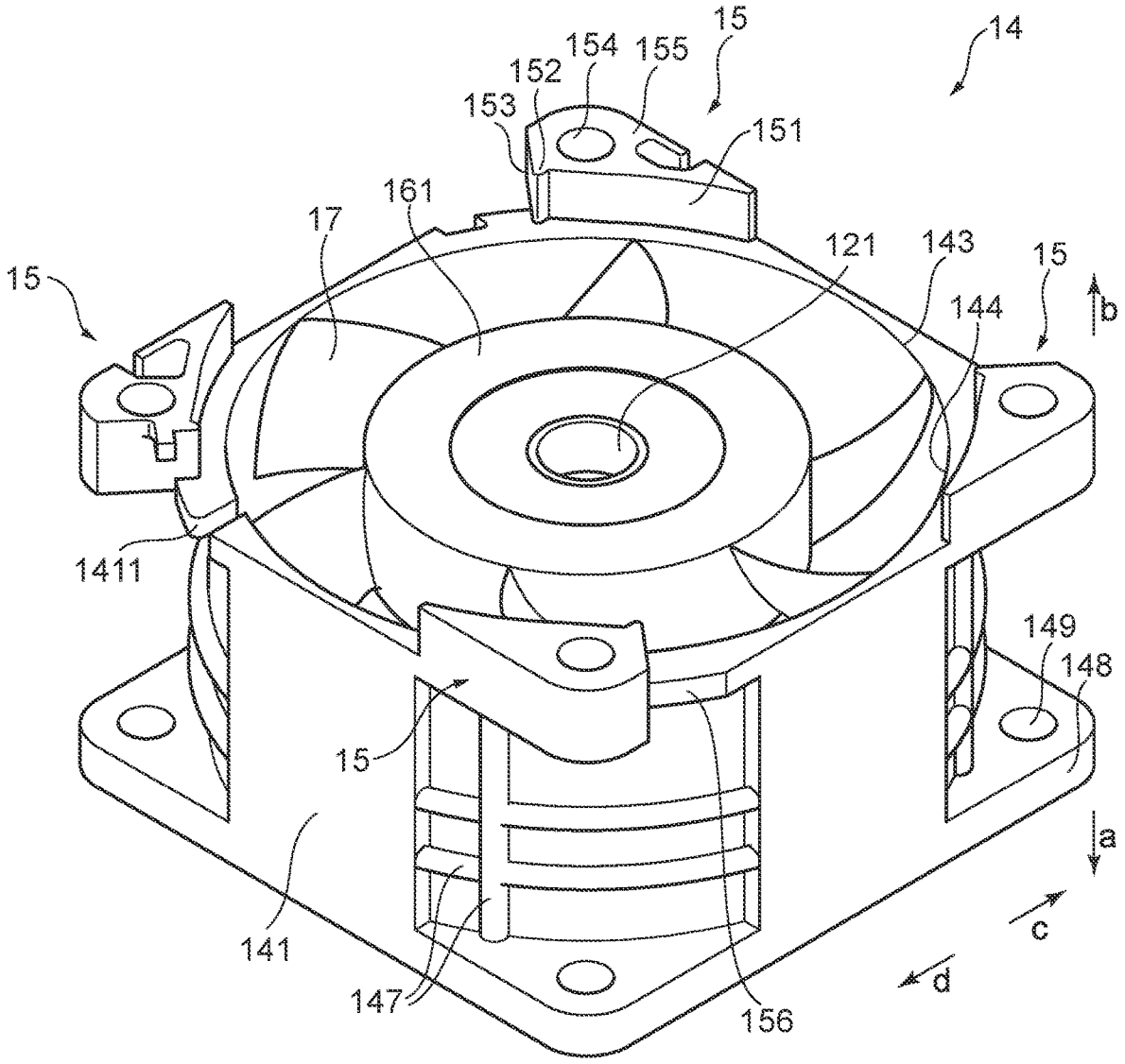
FIG. 4 is a perspective view of the first casing shown in FIG. 2.
Figure 5:
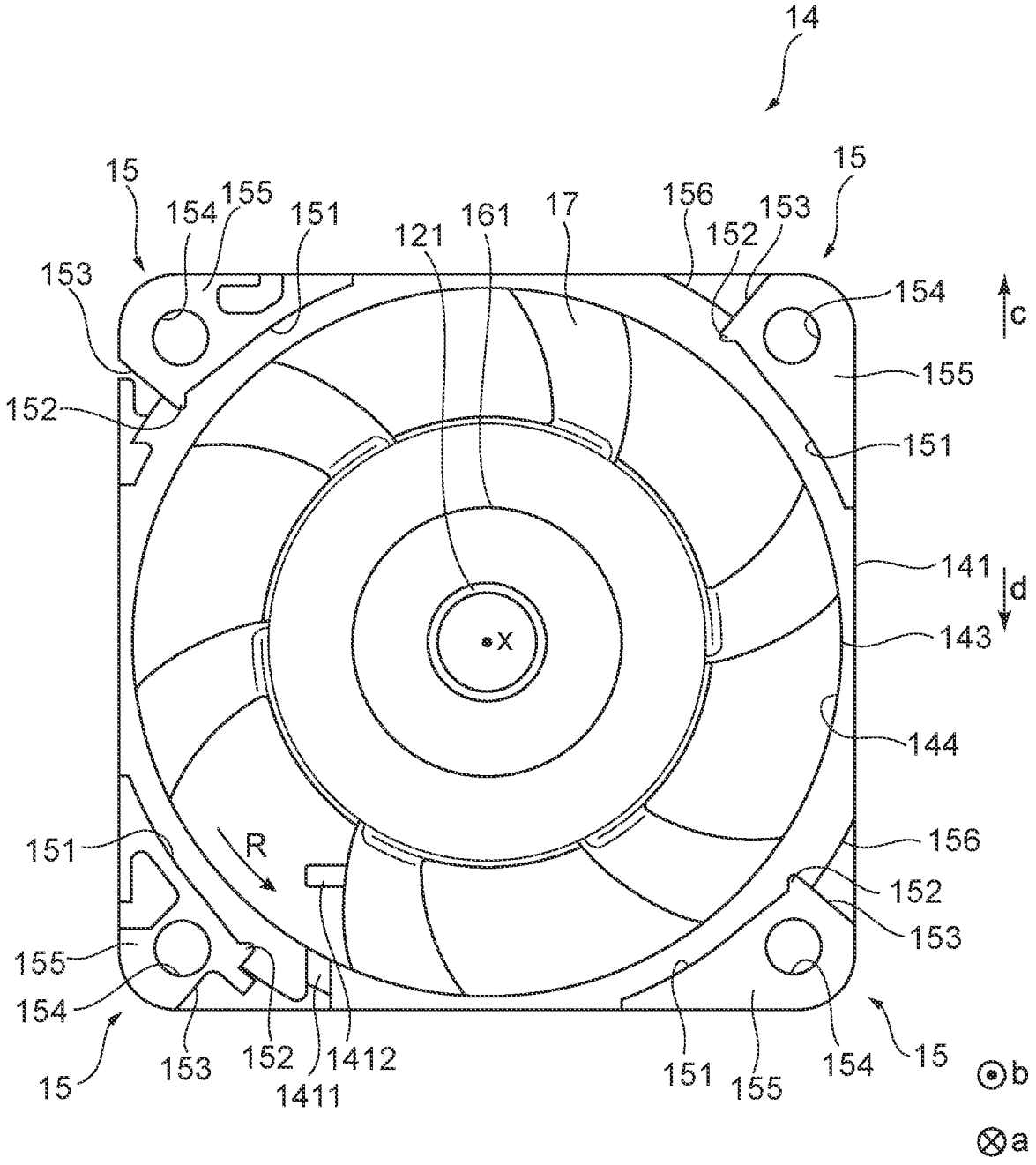
FIG. 5 is a plan view showing a state of the first casing shown in FIG. 4 as viewed from the discharge port side.
Figure 6:
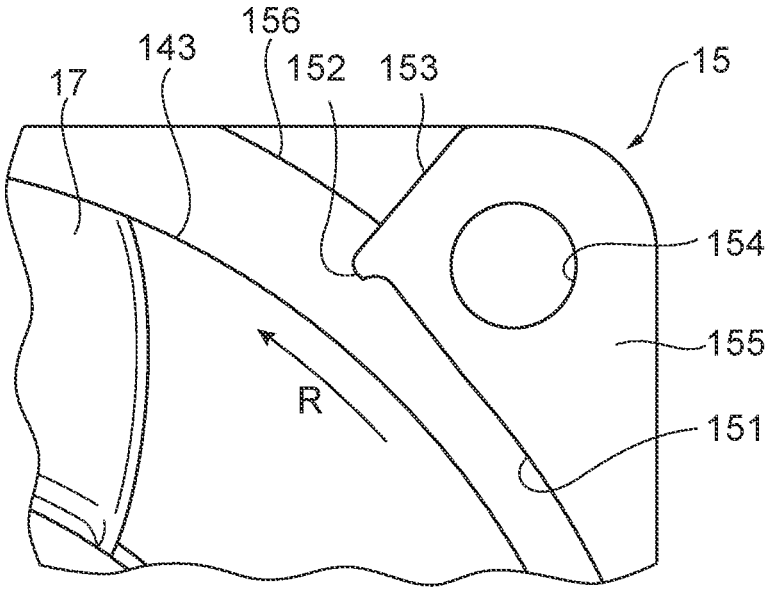
FIG. 6 is an enlarged plan view showing a first engagement flange portion of the first casing shown in FIG. 5.

FIG. 2 is a perspective view schematically showing the configuration of the first casing 14 and the second casing 24 of the axial flow fan device 1, and is also a perspective view showing a state of the first casing 14 and the second casing 24 as viewed from a suction port 142 side of the first casing 14. FIG. 3 is a perspective view schematically showing the configuration of the first casing 14 and the second casing 24 of the axial flow fan device 1 shown in FIG. 1, and is also a perspective view showing the first casing 14 and the second casing 24 as viewed from a discharge port side of the second casing 24. FIG. 4 is a perspective view of the first casing 14. FIG. 5 is a plan view showing a state of the first casing 14 as viewed from a discharge port 143 side. Further, FIG. 6 is an enlarged plan view showing the first engagement flange portion 15 of the first casing 14.

As shown in FIG. 1 to FIG. 5, the first casing 14 includes the first peripheral wall 141, the suction port 142, a discharge port 143, and a wind tunnel portion 144.

The first peripheral wall 141 is formed into a cylindrical shape or a substantially cylindrical shape to surround the first impeller 11 from the outer peripheral side "c". Reinforcing ribs 147, which reinforce the first peripheral wall 141, are formed on the outer peripheral surface of the first peripheral wall 141 to extend in the direction of the axis x and in the circumferential direction. The wind tunnel portion 144 having a hollow cylindrical shape is formed on the inner peripheral surface of the first peripheral wall 141 to dispose the first impeller 11. Further, the first casing 14 has an outlet groove 1411 through which a wire (not shown in the drawing) connected to the circuit board 133 passes.

The suction port 142 is formed at the end portion of the wind tunnel portion 144 on the upper side "a". The discharge port 143 is formed at the end portion of the wind tunnel portion 144 on the lower side "b". The suction port 142 causes the wind tunnel portion 144 and the outside to communicate with each other. The discharge port 143 causes the wind tunnel portion 144 and a suction port 242 of the second axial flow fan 20, which will be described later, to communicate with each other. The peripheral edge of the suction port 142 is not limited to have a linear shape, and may be formed of a curved surface, for example, to facilitate suction of air.

At the edge portion of the suction port 142 on the outer peripheral side "c", a flange portion 148 which extends outward in the radial direction is formed at a plurality of portions, for example, at four portions. Each flange portion 148 has a through hole 149 through which a fastening member (a bolt, for example) is inserted for attaching the first axial flow fan 10 to a housing not shown in the drawing. Four first engagement flange portions 15 are formed on the end surface having the discharge port 143, each first engagement flange portion 15 extending outward in the radial direction.

As shown in FIG. 4 to FIG. 6, each first engagement flange portion 15 includes an inner peripheral surface 151, the first engagement portion 152, a cut-away portion 153, and a through hole 154. The first engagement flange portion 15 is provided to protrude outward in the direction of the axis x (toward the lower side "b" in FIG. 2 and FIG. 4) from the surface on the front side (hereinafter referred to as "front surface") of a body portion 161 of the first base portion 16.

The inner peripheral surface 151 is formed into an arc shape or a substantially arc shape about the axis x to conform to the shape of a second peripheral wall such that the inner peripheral surface 151 is allowed to oppose this second peripheral wall of the second casing 24, which will be described later.

The two sets of first engagement portions 152 are provided at positions which protrude outward in the direction of the axis x from the front surface of the body portion 161 of the first base portion 16, and which are symmetrical with respect to the axis x. The first engagement portion 152 is a stepped portion which is formed on the inner peripheral surface 151 to protrude inward in the radial direction. The first engagement portion 152 is provided at one end portion of the inner peripheral surface 151 in the circumferential direction, for example. The first engagement portion 152, provided at one end portion of the inner peripheral surface 151, extends in the direction of the axis x. The first engagement portion 152 protrudes inward in the radial direction from the inner peripheral surface 151 in a gradually inclined manner. The first engagement portion 152 is inclined outward in the radial direction from the protruding vertex, and is connected to the cut-away portion 153. Provided that the first engagement portion 152 is formed to protrude inward in the radial direction, the shape of the first engagement portion 152 is not limited to the above-mentioned shape.

The cut-away portion 153 is provided at one end portion of the first engagement flange portion 15 in the circumferential direction, that is, at the end portion on the side where the first engagement portion 152 is provided. The cut-away portion 153 is formed such that a portion of the first engagement flange portion 15 is cut away in a substantially straight shape extending in the radial direction so that the cut-away portion 153 has a plane. The through hole 154 is a hole penetrating in the direction of the axis x to allow the insertion of the fastening member (the bolt, for example) for attaching the first axial flow fan 10 to the housing not shown in the drawing.

The first base portion 16 is disposed on the discharge port 143 side of the first casing 14. The first base portion 16 includes the body portion 161 having a disk shape, the boss portion 162 having a hollow cylindrical shape, and an outer peripheral wall 163 having a cylindrical shape. The boss portion 162 is formed at the center of the body portion 161 (the center position where the axis x extends), and is erected in the direction of the axis x. The outer peripheral wall 163 is formed at the outer peripheral edge of the body portion 161, and extends in the direction of the axis x. The first base portion 16 also includes a plurality of ribs 164 on the surface of the body portion 161 on the upper side "a" (the suction port 142 side), the ribs 164 extending radially between the boss portion 162 and the outer peripheral wall 163. The ribs 164 are formed to increase strength of the first base portion 16.

The first fixed blade 17 is a member having a blade shape, and a plurality of (six, for example) first fixed blades 17 are arranged equidistantly in the circumferential direction to face the discharge port 143. Each first fixed blade 17 is inclined at a predetermined angle with respect to the direction of the axis x. The first fixed blades 17 connect the outer peripheral wall 163 of the first base portion 16 and the inner peripheral surface of the wind tunnel portion 144 with each other.

In the first axial flow fan 10, the first casing 14, the first engagement flange portions 15, the first base portion 16, and the first fixed blades 17 are integrally molded out of a resin (a PBT resin, for example).

[Schematic Configuration of Second Axial Flow Fan]

Next, the configuration of the second axial flow fan 20 of the axial flow fan device 1 will be described.

As shown in FIG. 1, the second axial flow fan 20 includes the second impeller 21, the second motor 23, the second casing 24, second engagement flange portions 25, the second base portion 26, and second fixed blades 27.

The second impeller 21 is disposed in the second casing 24 about the axis x. The second impeller 21 includes a cup-shaped hub 211, and a plurality of (five, for example) blades 212, the hub 211 being open toward the upper side "a", the plurality of blades 212 being arranged equidistantly in the circumferential direction to extend from the outer peripheral surface of the hub 211. The second impeller 21 is formed such that the hub 211 and the blades 212 are integrally molded out of a resin.

The second motor 23 is formed of an outer rotor three-phase brushless motor, for example. The second motor 23 includes the shaft 22, a bearing holder 221, bearings 222, a stator core 231, and a rotor 232. A rotor magnet is attached to the inner peripheral surface of the rotor 232, and the rotor 232 is coupled to one end side of the shaft 22.

The shaft 22 is rotatably supported by the pair of bearings 222 mounted on the bearing holder 221.

The bearing holder 221 is mounted on a boss portion 262 of the second base portion 26. The bearing holder 221 is a cylindrical member made of metal (brass, for example), and has a space at an inner peripheral portion of the bearing holder 221. The bearing holder 221 is mounted on the second base portion 26, made of a resin, by a proper method, such as insertion molding. In the space at the inner peripheral portion of the bearing holder 221, the pair of bearings 222 which rotatably supports the shaft 22 of the second base portion 26 is mounted.

The stator core 231 is mounted on the outer periphery of the bearing holder 221. A circuit board 233 having a donut shape, for example, is attached to the portion of the stator core 231 on the upper side "a". The hub 211 of the second impeller 21 is mounted on the outer peripheral surface of the rotor 232. In the second motor 23, the second impeller 21 also rotates with the rotation of the rotor 232.

[Configuration of Second Casing]

Next, the configuration of the second casing 24 of the second axial flow fan 20 will be described.

Figure 7:
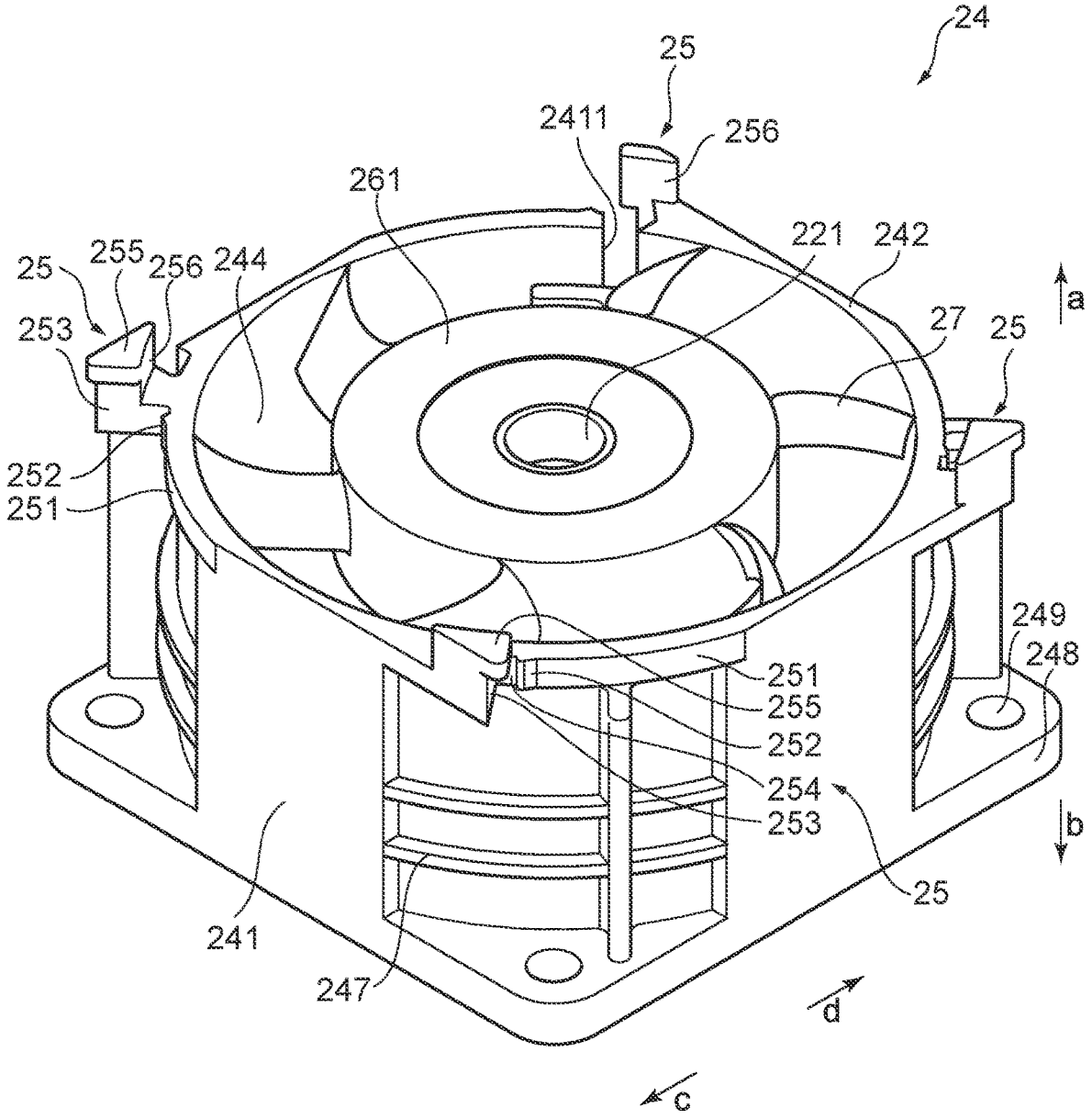
FIG. 7 is a perspective view of the second casing shown in FIG. 2.
Figure 8:
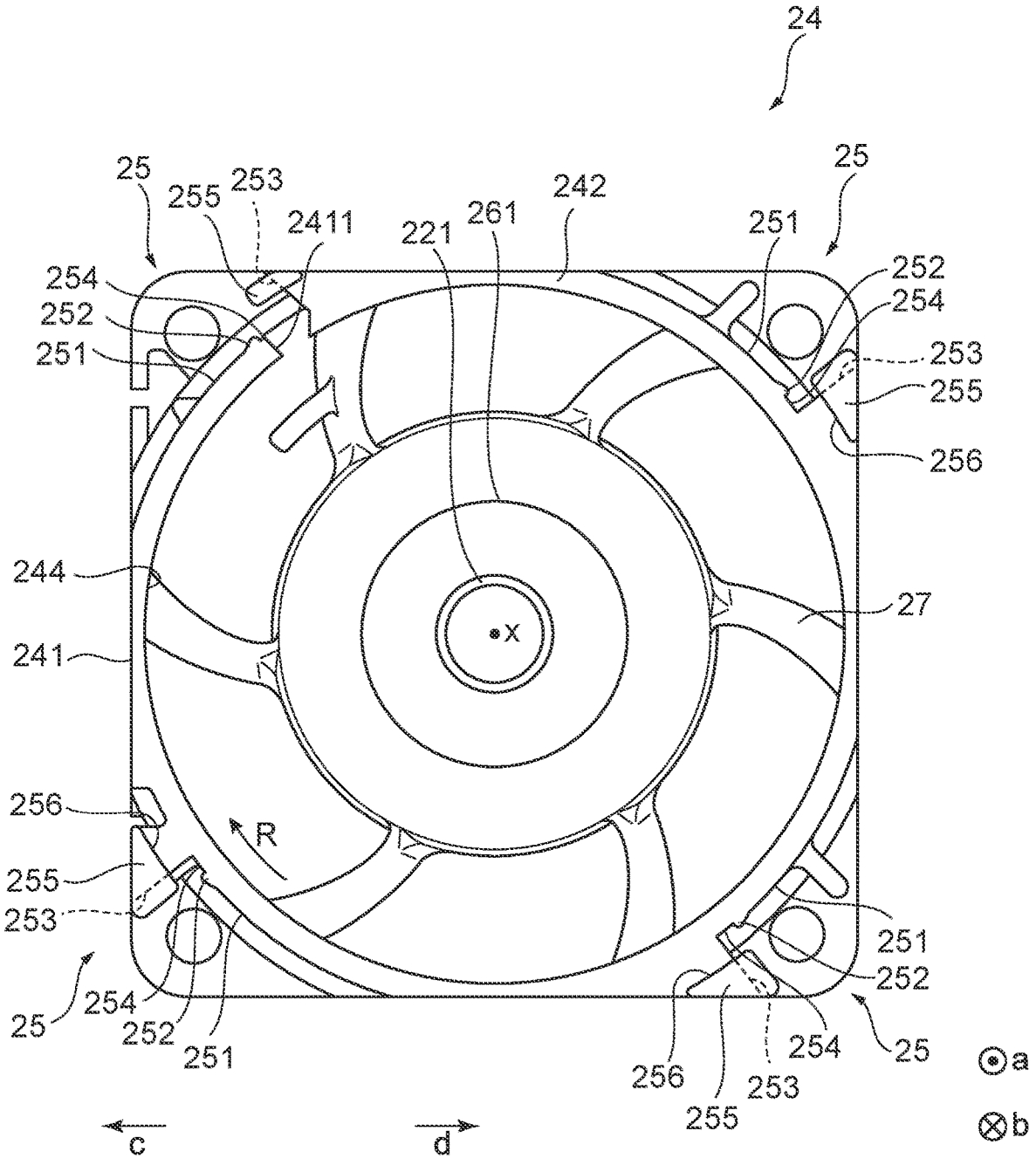
FIG. 8 is a plan view showing a state of the second casing shown in FIG. 7 as viewed from the suction port side.
Figure 9:
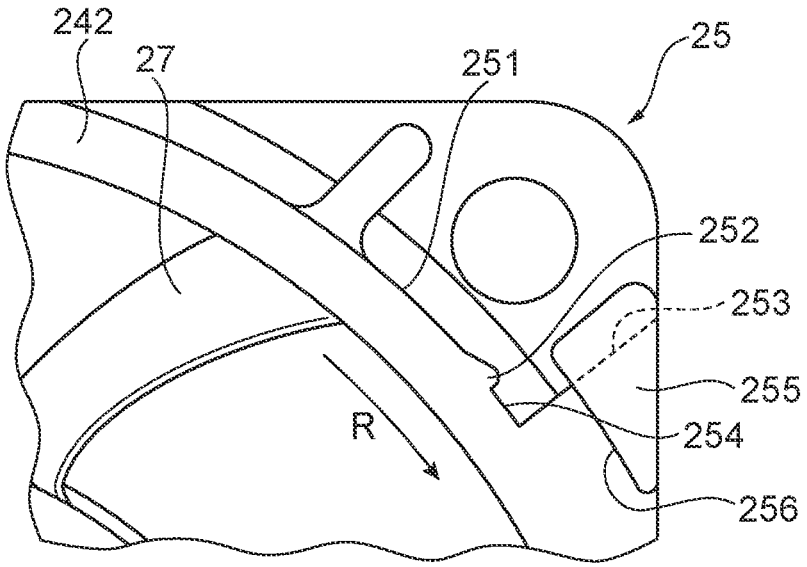
FIG. 9 is an enlarged plan view showing a second engagement flange portion of the second casing shown in FIG. 8.

FIG. 7 is a perspective view of the second casing 24. FIG. 8 is a plan view showing the second casing 24 as viewed from the suction port 242 side. Further, FIG. 9 is an enlarged plan view showing the second engagement flange portion 25 of the second casing 24.

As shown in FIG. 1 to FIG. 3 and FIG. 7 to FIG. 9, the second casing 24 includes the second peripheral wall 241, the suction port 242, a discharge port 243, and a wind tunnel portion 244. Further, the second casing 24 has an outlet groove 2411 through which a wire (not shown in the drawing) connected to the circuit board 233 passes.

The second peripheral wall 241 is formed into a cylindrical shape or a substantially cylindrical shape to surround the second impeller 21 from the outer peripheral side "c". Reinforcing ribs 247, which reinforce the second peripheral wall 241, are formed on the outer peripheral surface of the second peripheral wall 241 to extend in the direction of the axis x and in the circumferential direction. The wind tunnel portion 244 having a hollow cylindrical shape is formed on the inner peripheral surface of the second peripheral wall 241 to dispose the second impeller 21.

The suction port 242 is formed at the end portion of the wind tunnel portion 244 on the upper side "a". The discharge port 243 is formed at the end portion of the wind tunnel portion 244 on the lower side "b". The suction port 242 causes the discharge port 143 of the first axial flow fan 10 and the wind tunnel portion 244 to communicate with each other. The discharge port 243 causes the wind tunnel portion 244 and the outside to communicate with each other. The peripheral edge of the suction port 242 is not limited to have a linear shape, and may be formed of a curved surface, for example, to facilitate suction of air.

At the edge portion of the discharge port 243 on the outer peripheral side "c", a flange portion 248 which extends outward in the radial direction is formed at a plurality of portions, for example, at four portions. Each flange portion 248 has a through hole 249 through which a fastening member (a bolt, for example) is inserted for attaching the second axial flow fan 20 to the housing not shown in the drawing. Four second engagement flange portions 25 are formed on the end surface having the suction port 242, each second engagement flange portion 25 extending outward in the radial direction.

As shown in FIG. 7 to FIG. 9, each second engagement flange portion 25 includes an outer peripheral surface 251, the second engagement portion 252, a joint portions 253, a stepped portion 254, and a protruding portion 255. The second engagement flange portion 25 is provided to protrude outward in the direction of the axis x (toward the upper side "a" in FIG. 2 and FIG. 7) from the surface on the front side (hereinafter referred to as "front surface") of a body portion 261 of the second base portion 26.

The outer peripheral surface 251 is provided at the end portion of the second peripheral wall 241 on the upper side "a", the second peripheral wall 241 surrounding the outer periphery of the second impeller 21. At least a portion of the outer peripheral surface 251 is formed into an arc shape or a substantially arc shape about the axis x to conform to the shape of the inner peripheral surface 151 such that the outer peripheral surface 251 is allowed to oppose the inner peripheral surface 151 of the first engagement flange portion 15 of the first casing 14.

The two sets of second engagement portions 252 are provided on the second peripheral wall 241 at positions which are symmetrical with respect to the axis x. The second engagement portion 252 is a stepped portion which is formed on the outer peripheral surface 251 to protrude outward in the radial direction. The second engagement portions 252 are provided on the outer peripheral surface 251 of the second peripheral wall 241 at positions which correspond to the first engagement portions 152 in the circumferential direction. Each second engagement portion 252 provided on the outer peripheral surface 251 extends in the direction of the axis x. The second engagement portion 252 protrudes outward in the radial direction from the outer peripheral surface 251 in a gradually inclined manner, and reaches the vertex. The second engagement portion 252 is inclined inward in the radial direction from the vertex, and is connected to the stepped portion 254. The stepped portion 254 is connected to the joint portion 253. Provided that the second engagement portion 252 is formed to protrude outward in the radial direction, the shape of the second engagement portion 252 is not limited to the above-mentioned shape.

The joint portion 253 is provided at one end portion of the second engagement flange portion 25 in the circumferential direction. In the same manner as the cut-away portion 153 of the first engagement flange portion 15, the joint portion 253 is formed such that a portion of the second engagement flange portion 25 is cut away in a substantially straight shape extending in the radial direction so that the joint portion 253 has a plane. When the first casing 14 and the second casing 24 are coupled with each other by rotating and sliding, the joint portions 253 oppose the cut-away portions 153 of the first engagement flange portions 15.

The stepped portion 254 is provided on the outer peripheral surface 251 at a position between the second engagement portion 252 and the joint portion 253.

The protruding portion 255 is formed to extend in a direction opposite to the rotational direction R from the end portion of the joint portion 253 on the outer side in the direction of the axis x (the upper side "a" in FIG. 7). The protruding portion 255 overhangs from the joint portion 253.

The second base portion 26 is disposed on the suction port 242 side of the second casing 24. The second casing 24 includes the body portion 261 having a disk shape, the boss portion 262 having a hollow cylindrical shape, and an outer peripheral wall 263 having a cylindrical shape. The boss portion 262 is formed at the center of the body portion 261 (the center position where the axis x extends), and is erected in the direction of the axis x. The outer peripheral wall 263 is formed at the outer peripheral edge of the body portion 261, and extends in the direction of the axis x. The second base portion 26 also includes a plurality of ribs 264 on the surface of the body portion 261 on the lower side "b" (the discharge port 243 side), the ribs 264 extending radially between the boss portion 262 and the outer peripheral wall 263. The ribs 264 are formed to increase strength of the second base portion 26.

The second fixed blade 27 is a member having a blade shape, and a plurality of (six, for example) second fixed blades 27 are arranged equidistantly in the circumferential direction to face the suction port 242. Each second fixed blade 27 is inclined at a predetermined angle with respect to the direction of the axis x. The second fixed blades 27 connect the outer peripheral wall of the second base portion 26 and the inner peripheral surface of the wind tunnel portion 244 with each other.

In the second axial flow fan 20, the second casing 24, the second engagement flange portions 25, the second base portion 26, and the second fixed blades 27 are integrally molded out of a resin (a PBT resin, for example).

The axial flow fan device 1 having the above-mentioned configuration suctions a gas (air, for example) into the wind tunnel portion 144 from the suction port 142 of the first axial flow fan 10. The gas suctioned into the wind tunnel portion 144 flows in the inside of the wind tunnel portion 144 of the first axial flow fan 10, and flows into the suction port 242 of the second axial flow fan 20 from the discharge port 143 of the first axial flow fan 10. The air which flows into the wind tunnel portion 244 from the suction port 242 of the second axial flow fan 20 flows in the inside of the wind tunnel portion 244 of the second axial flow fan 20, and is discharged to the outside from the discharge port 243 of the second axial flow fan 20.

[Coupling Operation Between First Axial Flow Fan 10 and Second Axial Flow Fan 20]

Next, the coupling operation between the first axial flow fan 10 and the second axial flow fan 20 in the axial flow fan device 1 having the above-mentioned configuration will be described.

Figure 10:
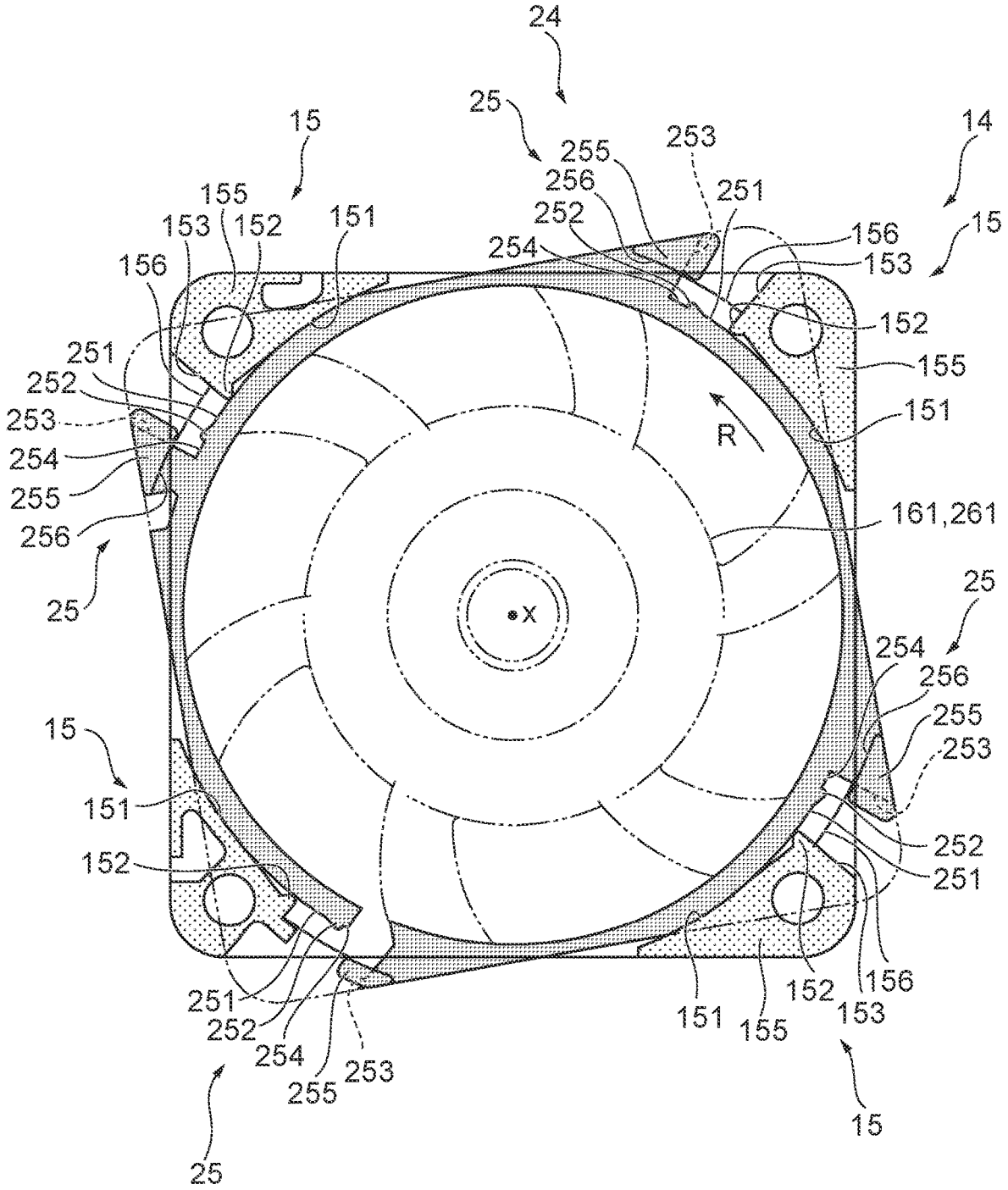
FIG. 10 is a plan view schematically showing a state of the axial flow fan device shown in FIG. 1 before first engagement portions of the first casing and second engagement portions of the second casing are engaged with each other.
Figure 11:
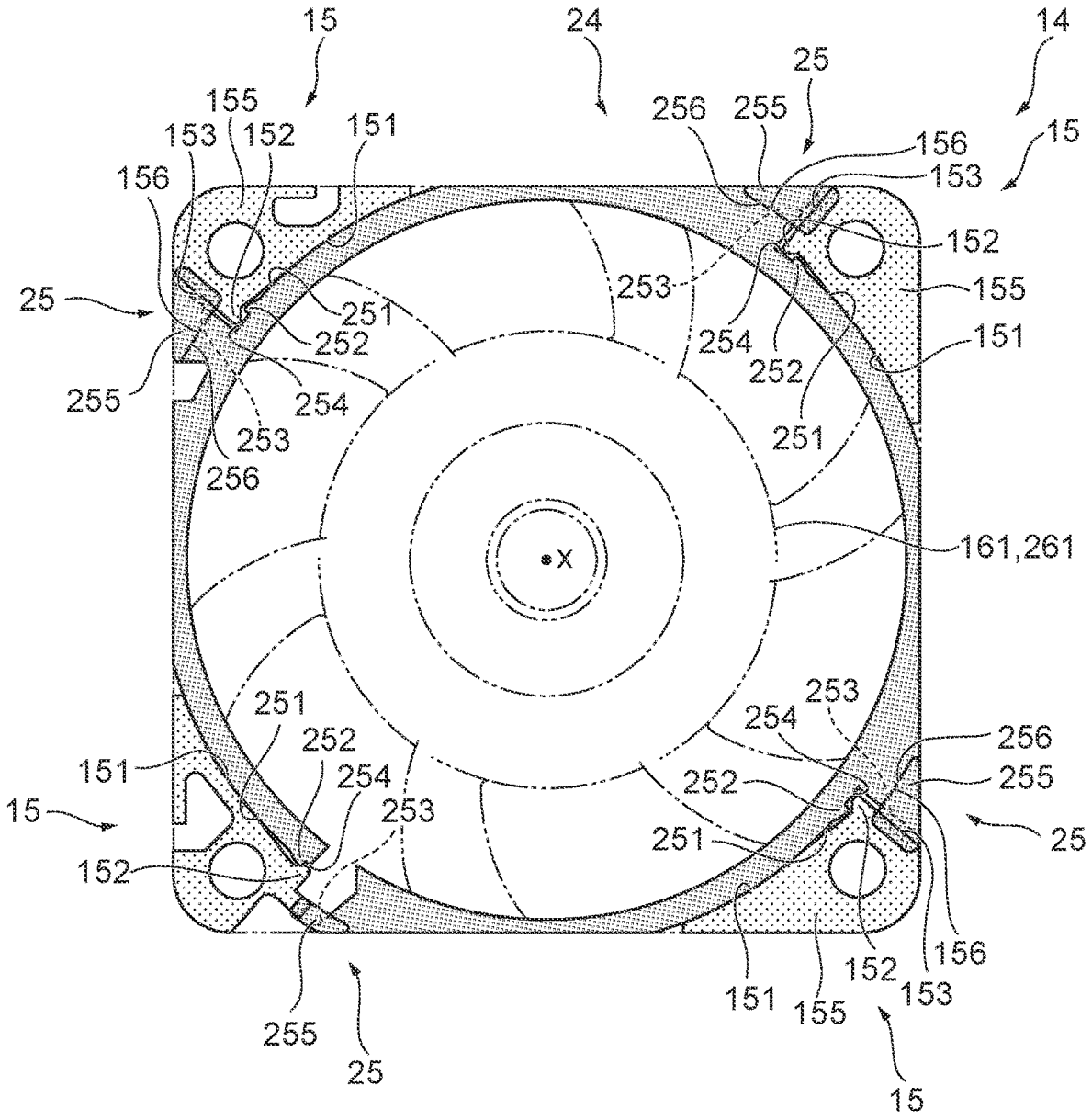
FIG. 11 is a plan view schematically showing a state of the axial flow fan device shown in FIG. 1 where the first engagement portions of the first casing and the second engagement portions of the second casing are engaged with each other.

FIG. 10 is a plan view schematically showing a state of the axial flow fan device 1 before the first engagement portions 152 of the first casing 14 and the second engagement portions 252 of the second casing 24 are engaged with each other. FIG. 11 is a plan view schematically showing a state of the axial flow fan device 1 where the first engagement portions 152 of the first casing 14 and the second engagement portions 252 of the second casing 24 are engaged with each other.

As shown in FIG. 2 and FIG. 3, in coupling the first axial flow fan 10 and the second axial flow fan 20 of the axial flow fan device 1, the end surface having the discharge port 143 of the first casing 14 of the first axial flow fan 10 and the end surface having the suction port 242 of the second casing 24 of the second axial flow fan 20 are caused to oppose each other. That is, in coupling the first axial flow fan 10 and the second axial flow fan 20, the first axial flow fan 10 and the second axial flow fan 20 are combined with each other such that the body portion 161 of the first base portion 16 of the first axial flow fan 10 and the body portion 261 of the second base portion 26 of the second axial flow fan 20 are disposed back to back.

As shown in FIG. 10, the end surface having the discharge port 143 of the first axial flow fan 10 and the end surface having the suction port 242 of the second axial flow fan 20 are brought into contact with each other. Thereafter, these end surfaces are caused to rotate and slide against each other in a predetermined rotational direction R. The two sets of first engagement portions 152 of the first casing 14 are provided at positions symmetrical with respect to the axis x, and the two sets of second engagement portions 252 of the second casing 24 are provided at positions symmetrical with respect to the axis x. The positions of the two sets of first engagement portions 152 in the circumferential direction correspond to the positions of the two sets of second engagement portions 252 in the circumferential direction. Accordingly, when the end surface of the first casing 14 and the end surface of the second casing 24 are caused to rotate and slide against each other, the outer peripheral surfaces 251 of the second engagement flange portions 25, provided on the suction port 242 side of the second casing 24 of the second axial flow fan 20, are guided by the inner peripheral surfaces 151 of the first engagement flange portions 15, provided on the discharge port 143 side of the first casing 14 of the first axial flow fan 10.

In a similar manner, outer peripheral surfaces 156 of the first peripheral wall 141 on the discharge port 143 side of the first casing 14 of the first axial flow fan 10 shown in FIG. 4 and FIG. 5 are guided by inner peripheral surfaces 256 of the second engagement flange portions 25 on the suction port 242 side of the second casing 24 of the second axial flow fan 20 shown in FIG. 7 and FIG. 8.

As shown in FIG. 11, when the rotation and sliding of the end surfaces of the first casing 14 and the second casing 24 is continued, each first engagement portion 152 formed on the inner peripheral surface 151 of the first engagement flange portion 15, which is formed on the discharge port 143 side of the first casing 14 of the first axial flow fan 10, gets over each second engagement portion 252 formed on the outer peripheral surface 251 on the suction port 242 side of the second casing 24 of the second axial flow fan 20. Accordingly, the first engagement portion 152 fits into the stepped portion 254. With the fitting of the first engagement portion 152 on each stepped portion 254, the first engagement flange portions 15 and the second engagement flange portions 25 are engaged with each other to form rotation stops, which stop the rotation of the first casing 14 and the second casing 24 in the rotational direction R in the circumferential direction.

When the first engagement portion 152 of the first casing 14 gets over the second engagement portion 252 of the second casing, and is engaged with the stepped portion 254 by fitting, the inclination of the surface of the second engagement portion 252 positioned on the stepped portion 254 side is larger than the inclination of the surface of the second engagement portion 252 positioned on the outer peripheral surface 251. Therefore, according to the axial flow fan device 1, even when the first engagement portion 152, which gets over the second engagement portion 252, and fits into the stepped portion 254, is rotated in the direction opposite to the rotational direction R by an external force, it is possible to prevent that the first engagement portion 152 easily gets over the second engagement portion 252 so that the engagement between the first casing 14 and the second casing 24 is released.

The joint portion 253 of the second engagement flange portion 25 on the suction port 242 side of the second axial flow fan 20 contacts the cut-away portion 153 of the first engagement flange portion 15 on the discharge port 143 side of the first casing 14 of the first axial flow fan 10. With the contact of the joint portion 253 with the cut-away portion 153, the rotation of the first casing 14 and the second casing 24 is restricted so that the rotation and sliding is stopped. In such a state, the through hole 154 is formed only in the first engagement flange portion 15 of the first axial flow fan 10 so that there is no possibility that the position of the through hole 154 is displaced between the first casing 14 and the second casing 24. Further, in such a state, the protruding portion 255 of the second engagement flange portion 25 on the suction port 242 side of the second axial flow fan 20 is partially brought into contact with a portion of a plane portion 155 of the first engagement flange portion 15 on the discharge port 143 side of the first axial flow fan 10 in an overlapping manner in the direction of the axis x, the protruding portion 255 opposing the plane portion 155 in the direction of the axis x. Accordingly, the protruding portion 255 functions as a member which prevents removal in the direction of the axis x.

As has been described above, in the axial flow fan device 1, each second engagement portion 252, which is a portion of the second engagement flange portion 25 on the suction port 242 side of the second axial flow fan 20, is rotated and slid against each first engagement portion 152, which is a portion of the first engagement flange portion 15 on the discharge port 143 side of the first axial flow fan 10 and, thereafter, the second engagement portion 252 is engaged with the first engagement portion 152. With such a configuration, according to the axial flow fan device 1, it is possible to suppress that an excessive force is applied to the first engagement flange portion 15 and the second engagement flange portion 25 due to eccentricity of the first casing 14 and the second casing 24, thus causing breakage of the first casing 14 and the second casing 24.

As has been described above, in the axial flow fan device 1, when the coupled state between the first axial flow fan 10 and the second axial flow fan 20 is released, an external force which allows the first engagement portions 152 of the first casing 14 to get over the second engagement portions 252 of the second casing is applied in the direction opposite to the rotational direction R, thus causing the first engagement portions 152 and the second engagement portions 252 to rotate and slide against each other so that the engagement between the first engagement portions 152 and the second engagement portions 252 can be released. Therefore, according to the axial flow fan device 1, it is possible to easily release the coupled state between the first axial flow fan 10 and the second axial flow fan 20. As described above, according to the axial flow fan device 1, the first axial flow fan 10 and the second axial flow fan 20 can be easily attached and detached.

In the axial flow fan device 1, the first engagement flange portions 15, each including the first engagement portion 152, and the first casing 14 are integrally molded, and the second engagement flange portions 25, each including the second engagement portion 252, and the second casing 24 are integrally molded. Therefore, according to the axial flow fan device 1, it is possible to reduce the number of parts which form engagement portions for causing the first casing 14 and the second casing 24 to be engaged with each other, and it is also possible to suppress breakage of the engagement portion.

Further, as has been described above, the first fixed blades 17 of the first axial flow fan 10 and the second fixed blades 27 of the second axial flow fan 20 are disposed at the same positions in the circumferential direction. Further, the first fixed blades 17 and the second fixed blades 27 are disposed at predetermined positions and with an inclination which prevent disturbance of the flow of air, discharged from the first axial flow fan 10, caused by the fixed blades of the second axial flow fan 20. Therefore, according to the axial flow fan device 1, it is possible to efficiently obtain an output of the fan in the fan device where the plurality of axial flow fans are coupled in the direction of the axis x.

Therefore, according to the above-mentioned axial flow fan device 1, the first engagement portions 152 and the second engagement portions 252 are easily detachable, and breakage of the first engagement portion 152 and the second engagement portion 252 can be suppressed and hence, it is possible to increase the utility of the first engagement portions 152 and the second engagement portions 252. In the embodiment of the present disclosure, the number of blades 112 of the first axial flow fan 10 is equal to the number of blades 212 of the second axial flow fan 20. However, the number of the blades 112 and the number of the blades 212 are not limited to the above, and may differ from each other. Further, in the embodiment of the present disclosure, the end surface of the first casing 14 and the end surface of the second casing 24 are brought into contact with each other and, thereafter, these end surfaces are rotated in the circumferential direction. However, the configuration is not limited to such a configuration. For example, in the case where the end surface of the first casing 14 and the front surface of the first base portion 16 are coplanar, and the end surface of the second casing 24 and the front surface of the second base portion 26 are coplanar, both the end surface of the first casing 14 and the front surface of the second casing 24, and both the end surface of the second casing 24 and the front surface of the second base portion 26 form sliding surfaces. In such a case, the rotation and sliding may be performed after both the end surface of the first casing 14 and the front surface of the first base portion 16 and both the end surface of the second casing 24 and the front surface of the second base portion 26 contact each other.

In addition to the above, those who are skilled in the art may appropriately modify the configuration of the present disclosure according to the conventionally known knowledge. It goes without saying that such modification also falls within the scope of the present disclosure provided that the modification has the configuration of the present disclosure.

What is claimed is:

1. An axial flow fan device comprising: a first axial flow fan;

and a second axial flow fan, the first axial flow fan and the second axial flow fan being coupled with each other in a direction of an axis, wherein the first axial flow fan includes a first impeller and a first casing, the first impeller including a plurality of blades, the first casing accommodating a first motor which rotates the first impeller, the first casing includes a first peripheral wall formed to surround an outer periphery of the first impeller, a first base portion provided on a bottom surface of the first peripheral wall to support the first motor, and first engagement portions each having a stepped portion in a radial direction, two sets of the first engagement portions being provided at positions which protrude outward in the direction of the axis from the first base portion, and which are symmetrical with respect to the axis, the second axial flow fan includes a second impeller and a second casing, the second impeller including a plurality of blades, the second casing accommodating a second motor which rotates the second impeller, and the second casing includes a second peripheral wall surrounding an outer periphery of the second impeller, at least a portion of an outer peripheral surface of the second peripheral wall being formed into an arc shape about the axis, a second base portion provided on a bottom surface of the second peripheral wall to support the second motor, and second engagement portions each having a stepped portion in the radial direction, two sets of the second engagement portions being provided on the outer peripheral surface of the second peripheral wall at positions which are symmetrical with respect to the axis, wherein the first casing includes a first engagement flange portion provided to protrude outward in the direction of the axis from a front surface of the first base portion, the first engagement flange portion comprises an inner peripheral surface formed into a substantially arced shape about the axis along the second peripheral wall, and the first engagement portion formed protruding radially inward from the inner peripheral surface of the first engagement flange portion and a cut-away portion provided at one end portion of the first engagement flange portion in a circumferential direction, wherein the second casing includes a second engagement flange portion, the second engagement flange portion comprises the outer peripheral surface provided on the second peripheral wall, a stepped portion connected to the second engagement portion in the circumferential direction, a joint portion for contacting an end surface of the first engagement flange portion and a protruding portion extending circumferentially from an axial end portion of the joint portion, the protruding portion is formed to protrude outward in the direction of the axis from a front surface of the second base portion, the second engagement portion formed protruding to radially outward from the outer peripheral surface, which are provided on the outer peripheral surface of the second peripheral wall at positions which correspond to the first engagement portions in the circumferential direction, with rotation of the first casing and the second casing in the circumferential direction with an end surface of the first casing and an end surface of the second casing contacted with each other, the first engagement portions get over the second engagement portions, thus being engaged with the second engagement portions so that positions of the first engagement portions and positions of the second engagement portions in the circumferential direction are fixed, and the protruding portion of the second engagement flange portion and the first engagement flange portion overlap each other in the direction of the axis in a state where the cut-away portion of the first engagement flange portion contacts the joint portion of the second engagement flange portion.

2. The axial flow fan device according to claim 1, wherein the first engagement flange portion has a through hole which penetrates in the direction of the axis, and the through hole is penetrated by a fastening member only in the state where the first engagement flange portion and second engagement flange portion overlap in the direction of the axis.

3. The axial flow fan device according to claim 1, wherein the first base portion includes a plurality of fixed blades, and the second base portion includes a plurality of fixed blades, and positions of the plurality of fixed blades of the first base portion and positions of the plurality of fixed blades of the second base portion correspond to each other in the circumferential direction in a state where the first engagement portions and the second engagement portions are engaged with each other.

4. The axial flow fan device according to claim 1, wherein the first engagement portion is disposed of proximate the cut-away portion of the first engagement flange portion.

* * * * *